United States Patent [19]

Gerritsen

[11] Patent Number: 4,902,928

[45] Date of Patent: Feb. 20, 1990

[54] COLOR DISPLAY TUBE

[75] Inventor: Jan Gerritsen, Eindhoven, Netherlands

[73] Assignee: U.S. Philips Corporation, New York, N.Y.

[21] Appl. No.: 902,095

[22] Filed: Aug. 27, 1986

Related U.S. Application Data

[63] Continuation of Ser. No. 607,544, May 7, 1984, abandoned.

[30] Foreign Application Priority Data

May 13, 1983 [NL] Netherlands ..... 8301712

[51] Int. Cl.[4] ..... H01J 29/54; H01J 29/70

[52] U.S. Cl. ..... 313/412; 313/431

[58] Field of Search ..... 313/412, 413, 414, 440, 313/431; 315/370

[56] References Cited

U.S. PATENT DOCUMENTS 3,252,032 5/1966 Kautz et al. ..... 313/417
3,949,262 4/1976 Ohkoshi et al. ..... 313/414
4,330,709 5/1982 de Chambost ..... 313/431
4,346,327 8/1982 Barten ..... 313/413
4,415,831 11/1983 Konosu ..... 313/440

*Primary Examiner*—Kenneth Wieder
*Attorney, Agent, or Firm*—Robert J. Kraus

[57] ABSTRACT

In a color display tube including an electron gun system for producing three electron beams situated with their axes in one plane, coincides to the said plane, curved field shapers 27, 28 are provided at the end of the system. Each field shaper comprises at least three plates of ferromagnetic material. The plates are situated symmetrically with respect to the plane and the central beam axis, and the curved field shapers face the three beam with their concave sides. The field shapers make the edge field of the frame deflection field pin-cushion-shaped. Each field shaper comprises at least two circumferentially-spaced plates and slots 35, 36 between the plates are covered by plates 31, 34, so that at least one magnetic shunt is formed in each field shaper. The line deflection field is attenuated less and a field disturbance at the area of the electron beams is prevented.

6 Claims, 6 Drawing Sheets

COLOR DISPLAY TUBE

This is a continuation of application Ser. No. 607,544, filed 7 May 1984, now abandoned.

BACKGROUND OF THE INVENTION

The invention relates to a colour display tube comprising in an evacuated envelope an electron gun system of the "in-line" type for generating three electron beams situated with their axes in one plane. The axis of the central beam coincides with the tube axis, and the electron beams converge on a display screen provided on a wall of the envelope. In operation the beams are deflected over the display screen in two mutually perpendicular directions by means of a first and a second deflection field. The direction of the first deflection field is parallel to the plane. The electron gun system comprises at its end curved field shapers for causing the rasters described on the display screen by the electron beams to co-incide as much as possible. Each field shaper includes at least three plates of ferromagnetic material, the plates being situated symmetrically with respect to the plane and the central beam axis, the curved field shapers facing the three beams with their concave sides and making the edge field of the first deflection field pincushion-shaped.

A frequently occurring problem in colour display tubes having an electron gun system of the "in-line" type is coma. This is expressed in the fact that the dimensions of the rasters which are written on the display screen by the three electron beams are different. This is the result of the eccentric location of the outermost electron beams relative to the field for the vertical deflection (the frame deflection field). In U.S. Pat. No. 4,196,370 a large number of patents are mentioned in which partial solutions are given. These solutions consist of using magnetic field conducting and/or screening rings and plates which are mounted at the end of the gun and which intensify or attenuate the deflection field or the deflection fields locally along a part of the paths of the electron beams. With a number of these means it is possible to cause the rasters written on the display screen by the three beams to coincide substantially. A disadvantage of the use of such means, however, is that a defocusing occurs in the outermost beams during deflection which is expressed in a distorted spot on the display screen, which spot is surrounded by a haze. One of the patents mentioned is U.S. Pat. No. 3,594,600 in which a colour display tube is described in which the rasters written by the three electron beams are made to coincide by placing two elongate C-shaped magnetic screens beyond the outermost electron beams. As a result of this the outermost electron beams are screened from the edge field of the line deflection field (the vertical field lines) while the edge field is admitted to the central electron beam. The three electron beams are screened from the edge field of the frame deflection field (the horizontal field lines) which is guided entirely around the three beams.

In Netherlands Patent Application 78 01 317 (corresponding to U.S. Pat. No. 4,237,437) laid open to public inspection a system of deflection coils is described in which field shaping means are provided in the deflection coil system. They consist, for example, of two soft-magnetic elements which are arranged diametrically opposite to each other and substantially transversely to the magnetic field of the frame deflection coil, on the neck side of the system of deflection coil, beyond the line deflection coils. A disadvantage of the use of such field-shaping means is that a great part of the frame deflection field is distorted by such means, which consume a comparatively large amount of the deflection energy.

A colour display tube of the type mentioned in the opening paragraph is described in Netherlands Patent Application 8204465 (corresponding to U.S. Pat. No. 548,276 filed 3 Nov. 1983) which has not yet been laid open to public inspection and which may be considered to be incorporated herein by reference. The field shapers described in the patent application make the first deflection field (the frame deflection field) pincushion-shaped. The pincushion-shaped field comprises substantially a two-pole field having a six-pole component. As a result of the pincushion shape the field, also for the rays of the electron beams situated not on the electron beam axes, has the correct strength and shape so that the deflection defocusing of the outermost beams is considerably reduced. In contrast with the field shapers situated in the system of deflection coils according to the above-mentioned Netherlands Patent Application 78 01 137, the field shapers are situated comparatively closely to the electron beams and only a comparatively small part of the deflection field is distorted as a result of which only little extra deflection energy is necessary.

The said Netherlands Patent Application 8204465 describes that it is useful to provide slots in the field shapers and to manufacture the field shapers from two or three plates substantially located in the elongation of each other. The object of this is to reduce the losses in the line deflection field (the second deflection field). It is also stated that by providing slots between the plates of the field shapers situated in the elongation of each other a field disturbance occurs, which will be described in detail hereinafter with reference to a figure.

SUMMARY OF THE INVENTION

It is therefore an object of the invention to provide a colour display tube in which slots are provided between the plates of the field shapers situated in the elongation of each other so as to reduce the losses in the second deflection field but in which measures are taken to substantially prevent a field disturbance at the area of the electron beams.

A colour display tube of the kind mentioned in the opening paragraph is for that purpose characterized according to the invention in that each field shaper comprises at least two plates circumferentially spaced from each other and defining slots therebetween which are covered by plates so that at least one magnetic shunt for the second magnetic deflection field is formed in each field shaper.

The invention is based on the recognition of the fact that, if the field shapers are constructed in this manner, a resistance for the second deflection field is created in the field shapers which, however, does not disturb the shape of both the first and the second deflection field and the desired field is obtained.

A first preferred embodiment of the field shapers is characterized in that each field shaper consists of three plates, two plates of which are circumferentially space from each other and disposed symmetrically above and below the plane the third slot-covering plate intersects the plane and is also situated symmetrically with respect to the plane.

It is also possible to manufacture each field shaper from five plates, three of which are circumferentially spaced from each other and two of which cover the slots between the three plates.

The various plates are particularly simple to position and to connect when the electron gun system comprises at its end a centering cup in which the circumferentially-spaced plates are attached to the inner wall and the slot-covering plates are attached to the outer wall of the centering cup.

BRIEF DESCRIPTION OF THE DRAWING

The invention will now be described in greater detail, by way of example, with reference to the accompanying drawing, in which.

DESCRIPTION OF THE PREFERRED EMBODIMENTS

Figure 1:
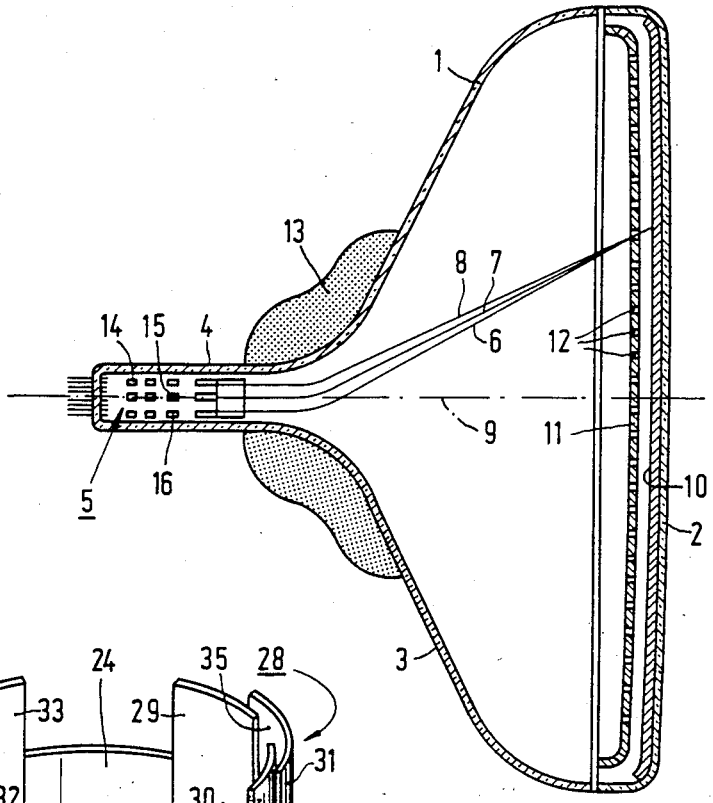
FIG. 1 is a longitudinal sectional view of a colour display tube according to the invention.
Figure 2:
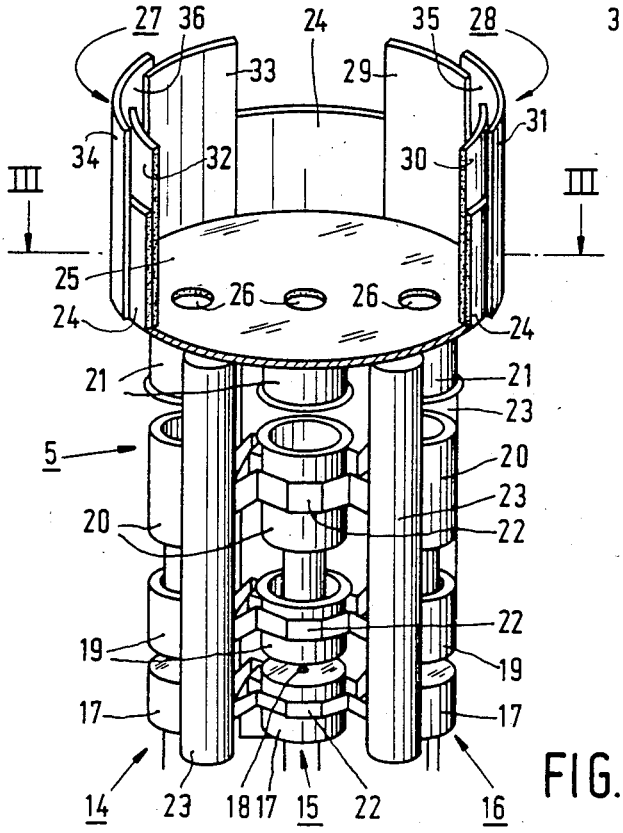
FIG. 2 is an elevation, partly broken away, of an electron gun system as used in the FIG. 1 tube.

FIG. 1 is a longitudinal sectional view of a colour display tube of the "in-line" type. In a glass envelope 1 which is composed of a display window 2, a cone 3 and a neck 4, an electron gun system 5 is provided in the neck and generates three electron beams 6, 7 and 8 which are situated with their axes in one plane (the plane of the drawing). The axis of the central electron beam 7 before deflection coincides with the tube axis 9. The display window 2 comprises on its inside a large number of triplets of phosphor lines. Each triplet comprises a line consisting of a blue-luminescing phosphor, a line consisting of a green luminescing phosphor, and a line consisting of a red-luminescing phosphor. All triplets together constitute the display screen 10. The phosphor lines are perpendicular to the plane of the drawing. A shadow mask 11 having a very large number of elongate apertures 12 through which the electron beams 6, 7, 8 pass and each impinging only on phosphor lines of one colour, is positioned in front of the display screen. The three electron beams situated in one plane are deflected by the system of deflection coils 13. By using the invention, a coma correction is given to the beams without deflection defocusing occurring and without this costing much extra deflection energy. In this case the electron gun system 5 consists of three separate electron guns 14, 15 and 16 as is also shown in FIG. 2 in a broken-away elevation. However, it is also possible to apply the invention to a so-called integrated electron gun system, as described, for example, in U.S. Pat. No. 4,196,370 in which the electron guns have a number of electrodes in common. The guns 14, 15 and 16 each comprise a control grid or electrode 17 which has an aperture 18. A cathode (not visible) for generating the electron beams is provided opposite the aperture in the control electrode. Each gun further comprises a second grid 19, a third grid 20, and a fourth grid 21. The grids 17, 19 and 20 are connected to glass rods 23 by means of metal strips 22. The grids 21 are connected against the bottom of a common centering cup 24 of non-ferromagnetic material. The bottom 25 of the centering cup 24 broken away in this case comprises three apertures 26 through which the electron beam pass. Two curved field shapers 27 and 28 each consisting of three curved plates 29, 30, 31 and 32, 33, 34 of ferromagnetic material (for example, an alloy having 58% by weight of nickel and 42% by weight of iron) are provided against the inner wall and the outer wall of the centering cup 24. In this case the plates have a length (measured in the direction of the tube axis 9) of approximately 15 mm. and are circumferentially spaced to establish 2.7 mm wide slots 35 and 36 between the plates 29, 30 and 32, 33, respectively. The slots, viewed from the tube axis, are covered by the curved plates 31 and 34, radially spaced 0.25 mm from and overlapping the plates 29, 30 and 32 and 33, respectively. The overlapping plates 31 and 34 are spaced from the plates 29, 30 and 32, 33 by the cylindrical centering cup 24 consisting of non-ferromagnetic material. The diameter of the centering cup 24 is approximately 22 mm. The width of the plates 29, 30, 32 and 33 in the flat condition is 8.1 mm and the width of the plates 31 and 34, also in the flat (non-curved) condition, is 5.2 mm.

Figure 3:
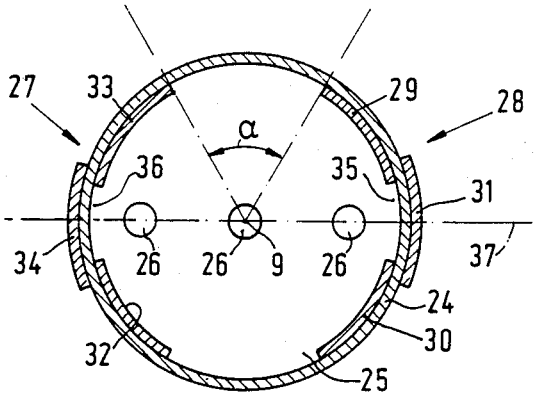
FIG. 3 is a sectional view through FIG. 2, FIGS. 4*a, b, c* and *d* show a frequently used solution and the effect on the beam and target thereof, as well as the desired field.

FIG. 3 is a sectional view through the centering cup 24 of FIG. 2. The desired extent of pincushion-shaped field distortion of the field parallel to line 37 (the frame deflection field) and possibly also the line deflection field which is perpendicular thereto can be influenced by a suitable choice of the length of the plates 29, 30, 31, 32, 33, 34 measured in the direction of the tube axis and of the angle $\alpha$ of the arc formed for example by the adjacent parallel edges of the plates 29 and 33. The field shapers are symmetrical with respect to the plane through the beam axis (the plane of the drawing of FIG. 1) and symmetrical with respect to the tube axis 9 which coincides with the axis of the central electron beam prior to deflection. The strength of the magnetic shunt can be adjusted by the choice of the thickness of the cylinder wall of the centering cup 24 and the extent of overlap of the plates 31 and 34 on the one hand and the plates 29, 30, 32 and 33 on the other hand.

Figure 4A:
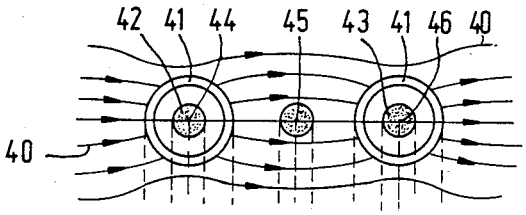
FIG. 4a PRIOR ART
Figure 4B:
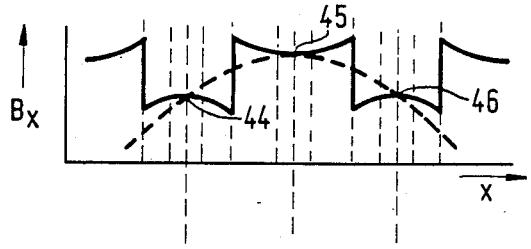
FIG. 4b PRIOR ART
Figure 4C:
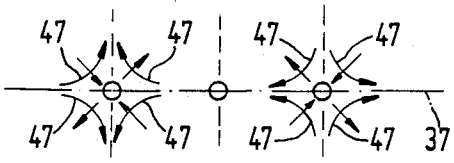
FIG. 4c PRIOR ART
Figure 4D:
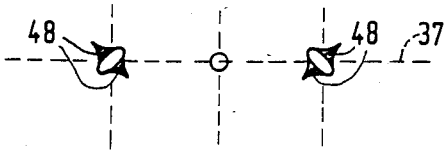
FIG. 4d PRIOR ART

As is shown diagrammatically in FIG. 4*a*, the magnetic field lines 40 are obstructed by the known rings 41 around the beyond the electron beams 42 and 43. The field strength variations $B_x$ in the plane through the beam axis (44, 45, 46) which is the result thereof, is shown in FIG. 4*b* by a solid line. The desired coma-free field is denoted by a broken line. By using the rings 41 the magnetic field $B_x$ at the area of the beam axes 44, 45 and 46 is equal to the desired magnetic field and the three rasters described on the display screen are made to coincide. For the rays of the outer beams 42 and 43 not coinciding with the beam axes the field does not have the correct field strength variation as a result of which a quadrupole lens action (quadrupole field lines 47) shown in FIG. 4*c* is exerted on the beams which is expressed in a deflection defocusing of the side beams. The radial arrows in FIG. 4*c* denote the forces which act on the beams. The spots on the display screen shown in FIG. 4*d* become elliptical and are surrounded by a haze. The axes of the ellipses in FIG. 4*d* enclose an angle of 45° with the line 37. The ellipticity of the spots is the result of an underfocusing. The haze areas 48 shown in broken lines are the result of overfocusing.

Figure 5A:
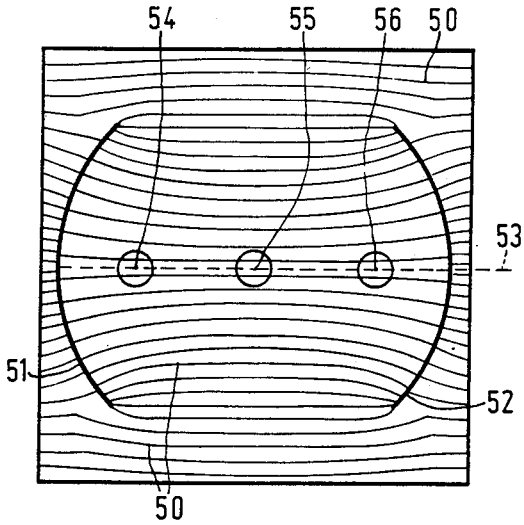
FIG. 5a PRIOR ART
FIG. 5*a* shows a part of the picture field with field shapers as described in a prior patent application.
Figure 5B:
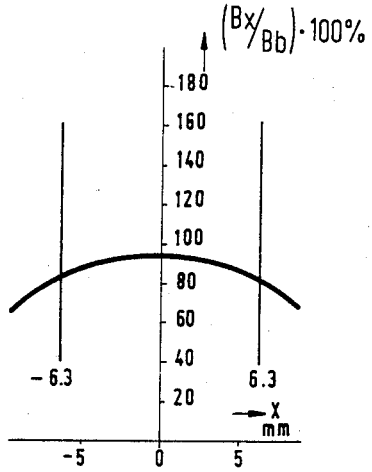
FIG. 5b PRIOR ART
FIG. 5*b* shows the variation of the picture field divided by the picture field presented by the deflection coils as a function of the location x on an axis perpendicular to the beam axis.
Figure 5C:
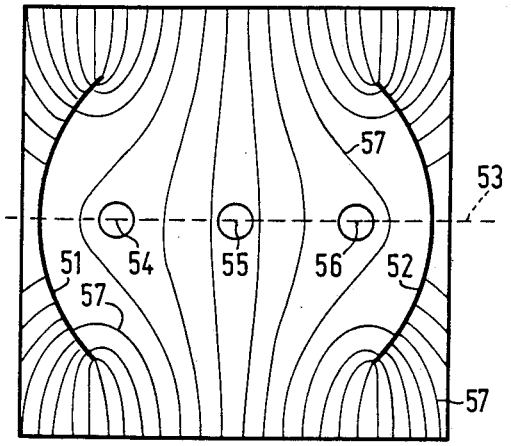
FIG. 5c PRIOR ART
FIG. 5*c* shows a part of the line field with field shapers as described in a prior patent application.
Figure 5D:
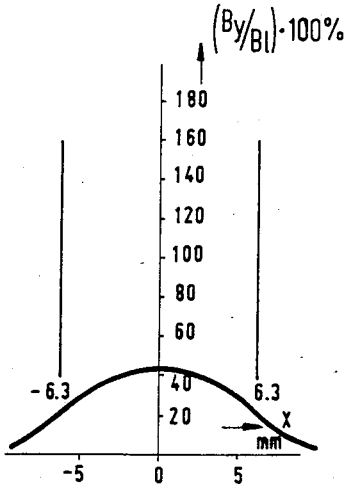
FIG. 5d PRIOR ART
FIG. 5*d* shows the variation of the line field divided by the picture field presented by the deflection coils as a function of the location x on an axis perpendicular to the beam axis.

The action of field shapers as they are described in the Netherlands Patent Application 8204465 will be described in greater detail with reference to FIGS. 5*a*, *b*, *c* and *d*. FIG. 5*a* shows a part of the frame deflection field, illustrated by a number of field lines 50. Two fields shapers 51 and 52 each consisting of one assembly are placed in the field at the end of the gun and distort the picture field in the desired manner in a pincushion shape. The pincushion shaped field consists substantially of a two-pole field having a six-pole component. FIG. 5*b* shows the variation of the magnetic field $B_x$ divided by the frame deflection of $B_b$ presented by the deflection coils as a function of the place x on the axis 53. At the area of the field shapers the mutual distance between the electron beams 54, 55 and 56 is approximately 6.3 mm. With such a field variation which corresponds to the desired field according to the broken line in FIG. 4*b* it is possible to eliminate the quadrupole error at the area of the side beams 54 and 56 and hence to considerably reduce the deflection defocusing of those beams. FIG. 5*c* shows a part of the line; field illustrated by a number of field lines 57. The variation of the magnetic field $B_y$ divided by the line field $B_1$ presented by the deflection coils as a function of the place x on the axis 53 is shown in FIG. 5*d*. From FIGS. 5*c* and 5*d* it follows that the line field at the area of the field shapers is considerably attenuated by the configuration of field shapers, especially in the region of the outermost beams 54 and 56.

Figure 6A:
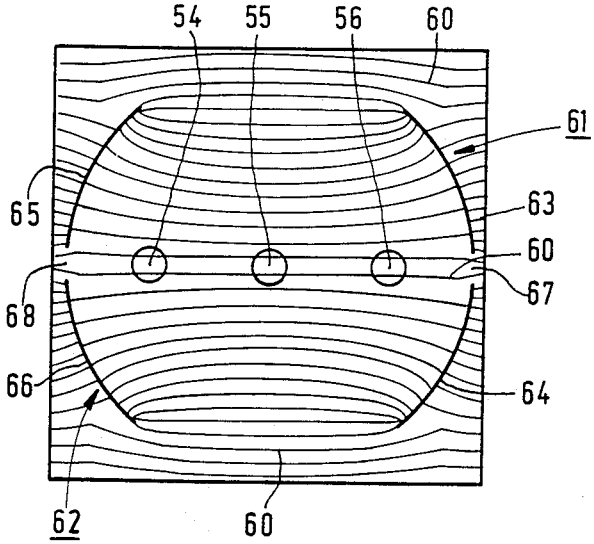
FIG. 6*a* shows a figure analogous to FIG. 5*a* but now with slots in the field shapers.
Figure 6B:
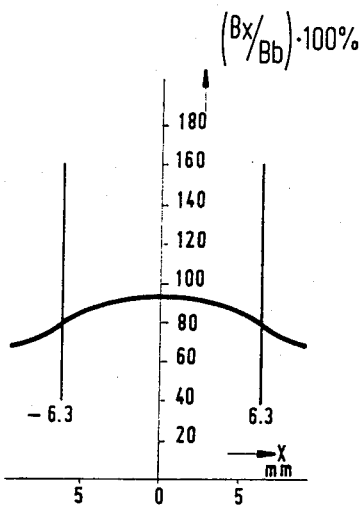
FIG. 6*b* shows a graph analogous to FIG. 5*b* for the field shapers and the field as shown in FIG. 6*a*.

FIG. 6*a* shows in a manner analogous to that of FIG. 5*a* a part of the frame deflection field illustrated by field a number of field lines 60. In this field two field shapers 61 and 62 are placed which each consist of two plates 63, 64 and 65, 66, respectively. The two plates forming each field shaper are side by side and are circumferentially spaced from each other. 1.9 mm wide slots 67 and 68 are provided between the plates. From FIG. 6*b* which is analogous to FIG. 5*b* it follows that the frame deflection field variation has not changed much by providing the slots 67 and 68 as compared with the frame deflection field variation shown in FIG. 5*b*.

Figure 6C:
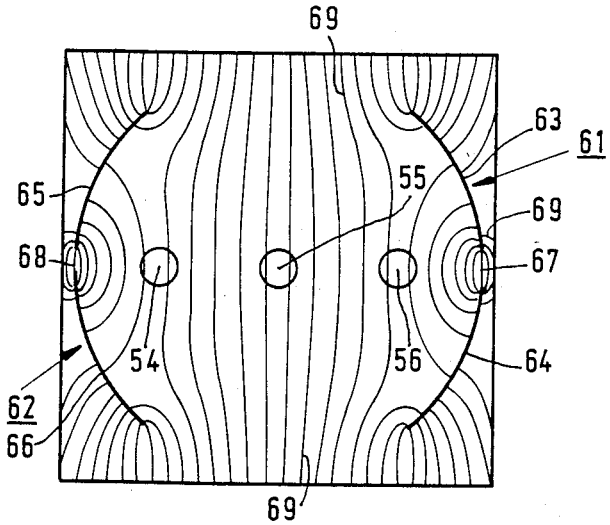
FIG. 6*c* shows a figure analogous to FIG. 5*c* but now with slots in the field shapers.
Figure 6D:
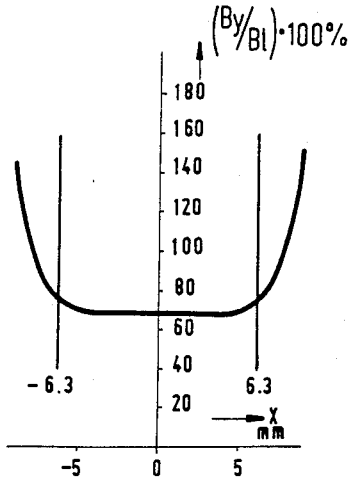
FIG. 6*d* shows a graph analogous to FIG. 5*b* for the field shapers and the field as shown in FIG. 6*c*.

FIG. 6*c* shows a part of the line field illustrated by a number of field lines 69. The variation of the magnetic field $B_y$ divided by the line field $B_1$ presented by the deflection coils as a function of the place x on the axis in a manner analogous to that of FIG. 5*d* is shown in FIG. 6*d*. From FIG. 6*d* it follows that the line field is attenuated much less by providing the slots 67 and 68. However, the variation of the line field is not good because it increases very considerably near the outermost beams 54 and 56.

Figure 7A:
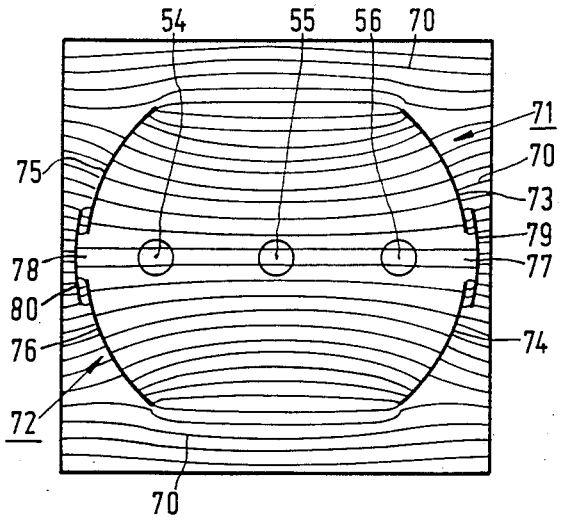
FIG. 7*a* shows a figure analogous to FIGS. 5*a* and 6*a* but now with field shapers according to the invention.
Figure 7B:
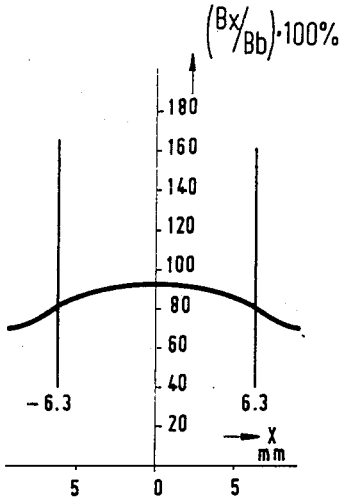
FIG. 7*b* shows a graph analogous to FIGS. 5*b* and 6*b* for the field shapers and the field as shown in FIG. 7*a*.

FIG. 7*a* shows in a manner analogous to that of FIGS. 5*a* and 6*a* a part of the frame deflection field, as illustrated by a number of field lines 70. In this case also, two curved field shapers 71 and 72 are placed in the field and each consists of two curved plates 73, 74 and 75, 76 respectively, each other on the same radius of curvature, and two curved plates 79 and 80 covering the slots 77 and 78. The plates 79 and 80 may also be flat. From FIG. 7*b* which is analogous to FIGS. 5*b* and 6*b* it follows that the frame field variation has not changed much as a result of the provision of the plates 79 and 80 as compared with the picture field variation shown in FIGS. 5*b* and 6*b*.

Figure 7C:
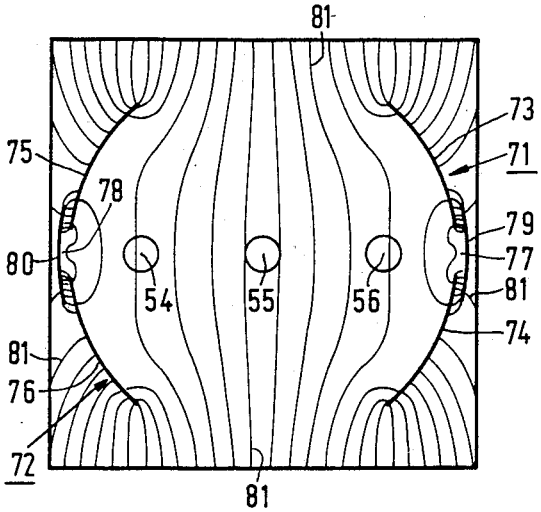
FIG. 7*c* shows a figure analogous to FIGS. 5*c* and 6*c* but now with field shapers according to the invention.
Figure 7D:
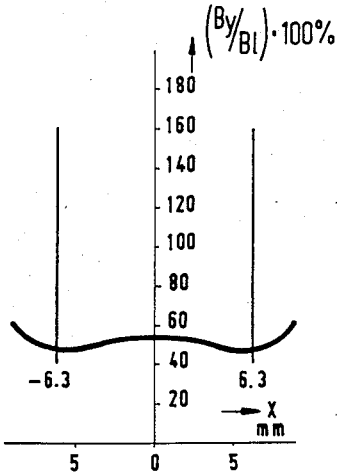
FIG. 7*d* shows a graph analogous to FIGS. 5*d* and 6*d* for field shapers and the field shown in FIG. 7*c*.

FIG. 7*c* shows a part of the line field illustrated by a number of field lines 81. From FIG. 7*d* which is analogous to FIG. 6*d* it follows that, although the line field is attenuated by covering the slots 77 and 78, the variation in the x direction is very flat. In other words, the line field is attenuated as compared with FIG. 6*d* but is not strongly distorted near the outer beams. This also follows from the comparison of FIGS. 7*c* and 6*c*.

Figure 8:
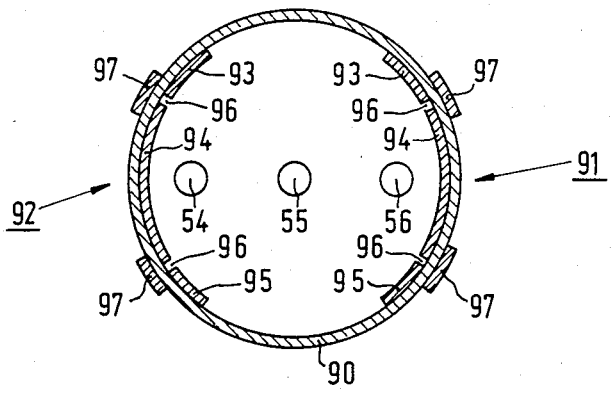
FIG. 8 is a sectional view of another embodiment of the invention.

FIG. 8 is a sectional view analogous to FIG. 3 through a centering cup 90. The curved field shapers 91 and 92 of this embodiment of the invention each consist of three plates 93, 94 95 which are circumferentially spaced from each other and lie on the same radius of curvature, and define therebetween 1.3 mm wide slots 96 which on the outside are covered at 0.3 mm distance by plates 97 which each form a magnetic shunt for the line field.

Figure 9:
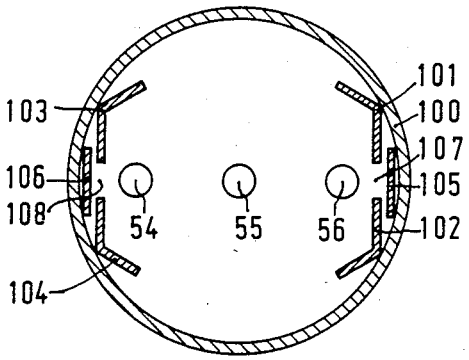
FIG. 9 is a sectional view of still another embodiment of the invention.

FIG. 9 also shows in a manner analogous to FIG. 3 a sectional view through a centering cup 100. The curved field shapers of this embodiment of the invention each consist of two bent plates 101, 102 and 103, 104, respectively, circumferentially spaced from each other, and two flat plates 105 and 106 which cover the slots 107 and 108, respectively.

What is claimed is:

1. A color display tube comprising:

(a) an evacuated envelope having a display window with an inner surface supporting a luminescent display screen;

(b) an electron gun system for producing central and first and second outer electron beams having their axes lying in a longitudinal plane intersecting the display screen, and for converging the electron beams toward a point of coincidence on said display screen;

(c) first and second deflection means disposed around the electron beam axes for producing first and second deflection fields for deflecting the electron beams in a first direction perpendicular to the longitudinal plane and in a second direction parallel to said plane, respectively; and (d) field shaping means, arranged at an end of the electron gun system from which the electron beams exit, for locally distorting at least one of the deflection fields to augment dynamic convergence of the electron beams such that there is coincidence on the display screen of respective rasters produced by said electron beams;

characterized in that the field shaping means comprises first and second ferromagnetic plate means arranged symmetrically with respect to both the longitudinal plane and the central beam axis, said plate means being arranged transversely to said longitudinal plane and shaped such that they partially surround the beam axes and distort the first deflection field, where the electron beams enter said field, such that said field is pin-cushioned-shaped, each of said plate means comprising at least first and second circumferentially-spaced plates defining a slot therebetween, and a third slot-covering plate radially spaced from said first and second plates and partially overlapping said plates, said slot-covering plates forming magnetic shunts across the slots covered thereby for shunting the second deflection field and minimizing distortion by said slots of said second deflection field.

2. A color display tube as in claim 1 where each of said ferromagnetic plate means comprises first and second circumferentially-spaced plates symmetrically disposed on opposite sides of the longitudinal plane, and where the third plate intersects said plane and is situated symmetrically with respect thereto.

3. A color display tube as in claim 1 or 2 where the electron gun system comprises at the end from which the electron beams exit a centering cup having an inner wall against which said circumferentially-spaced plates are disposed and having an outer wall against which said slot-covering plates are disposed.

4. A color display tube comprising:

(a) an evacuated envelope having a display window with an inner surface supporting a luminescent display screen;

(b) an electron gun system for producing central and first and second outer electron beams having their axes lying in a longitudinal plane intersecting the display screen, and for converging the electron beams toward a point of coincidence on said display screen;

(c) first and second deflection means disposed around the electron beam axes for producing first and second deflection fields for deflecting the electron beams, the first deflection field having lines of flux extending in a first direction generally parallel to the longitudinal plane, and the second deflection field having lines of flux extending in a second direction generally perpendicular to said plane; and (d) field shaping means, arranged at an end of the electron gum system from which the electron beams exit, for causing rasters written on the display screen by the electron beams to substantially coincide;

characterized in that the field shaping means comprises first and second ferromagnetic plate means arranged symmetrically with respect to both the longitudinal plane and the central beam axis, said first and second plate means being arranged outside the beam paths of the respective first and second beams, each of said first and second plate means being of generally concave form such that it is divergent relative to the longitudinal plane and partially surrounds the respective beam axis;

said first and second plate means each comprising at least first and second circumferentially-spaced plates defining a slot therebetween and a third slot-covering plate radially spaced from and partially overlapping said plates;

said circumferentially-spaced plates locally distorting the first deflection field to effect coincidence of the rasters, and said slot-covering plates minimizing distortion by said slots of said second deflection field.

5. A color display tube as in claim 4 where each of said ferromagnetic plate means comprises first and second circumferentially-spaced plates symmetrically disposed on opposite sides of the longitudinal plane, and where the third plate intersects said plane and is situated symmetrically with respect thereto.

6. A color display tube as in claim 4 or 5 where the electron gun system comprises at the end from which the electron beam exit a centering cup having an inner wall against which said circumferentially-spaced plates are disposed and having an outer wall against which said slot-covering plates are disposed.

* * * * *